US011371461B2

(12) United States Patent
Procknow et al.

(10) Patent No.: US 11,371,461 B2
(45) Date of Patent: Jun. 28, 2022

(54) ENGINE WITH CONTROL UNIT FOR LEAN BURN OPERATION

(71) Applicant: BRIGGS & STRATTON CORPORATION, Wauwatosa, WI (US)

(72) Inventors: David Procknow, Elm Grove, WI (US); Jacob Zuehl, Hartland, WI (US)

(73) Assignee: Briggs & Stratton, LLC, Wauwatosa, WI (US)

( * ) Notice: Subject to any disclaimer, the term of this patent is extended or adjusted under 35 U.S.C. 154(b) by 170 days.

(21) Appl. No.: 16/634,545

(22) PCT Filed: Jul. 27, 2018

(86) PCT No.: PCT/US2018/044042

§ 371 (c)(1),
(2) Date: Jan. 27, 2020

(87) PCT Pub. No.: WO2019/023548

PCT Pub. Date: Jan. 31, 2019

(65) Prior Publication Data

US 2021/0087995 A1 Mar. 25, 2021

Related U.S. Application Data

(60) Provisional application No. 62/538,498, filed on Jul. 28, 2017.

(51) Int. Cl.
*F02D 41/40* (2006.01)
*F02D 41/00* (2006.01)
(Continued)

(52) U.S. Cl.
CPC ..... *F02D 41/40* (2013.01); *F02D 41/0002* (2013.01); *F02D 41/1454* (2013.01);
(Continued)

(58) Field of Classification Search
CPC .. F02D 41/0002; F02D 41/40; F02D 41/1454; F02D 41/18; F02D 41/34
See application file for complete search history.

(56) References Cited

U.S. PATENT DOCUMENTS 3,835,819 A * 9/1974 Anderson, Jr. ..... F02D 41/26 123/406.6
4,771,752 A 9/1988 Nishimura et al.
(Continued)

FOREIGN PATENT DOCUMENTS

JP 2000-097079 A 4/2000

OTHER PUBLICATIONS

International Search Report and Written Opinion, PCT/US2018/044042, Briggs & Stratton Corporation (dated Dec. 7, 2018).

*Primary Examiner* — Sizo B Vilakazi
*Assistant Examiner* — Anthony L Bacon
(74) *Attorney, Agent, or Firm* — Foley & Lardner LLP

(57) ABSTRACT

An internal combustion engine includes an engine block including a cylinder, a piston positioned within the cylinder and configured to reciprocate in the cylinder, an electronic throttle control system including a motor and a throttle plate, an air flow sensor configured to detect an air mass flow rate, a fuel system for supplying a controlled amount of fuel to the cylinder including a fuel injector, and an engine control unit coupled to the fuel system and the electronic throttle control system. The engine control unit is configured to determine engine speed data including a current engine speed, a previous engine speed, and a desired engine speed, control a fuel injection duration based on the engine speed data, determine air-fuel ratio data comprising a current air-fuel ratio and a desired air-fuel ratio, and control a throttle plate position based on the air-fuel ratio data.

20 Claims, 8 Drawing Sheets

(51) Int. Cl.
*F02D 41/14* (2006.01)
*F02D 41/18* (2006.01)

(52) U.S. Cl.
CPC ..... *F02D 41/1475* (2013.01); *F02D 41/18* (2013.01); *F02D 2200/101* (2013.01)

(56) References Cited

U.S. PATENT DOCUMENTS

| | | | | |
|---|---|---|---|---|
| 5,406,927 | A | 4/1995 | Kato et al. | |
| 6,095,942 | A | 8/2000 | Yamaguchi et al. | |
| 6,505,594 | B1 * | 1/2003 | Katayama | F02P 5/06 123/179.18 |
| 2003/0209224 | A1 * | 11/2003 | Lee | F02P 5/152 123/339.11 |
| 2003/0209225 | A1 * | 11/2003 | Lee | F02D 35/0007 123/339.23 |
| 2009/0076707 | A1 * | 3/2009 | Sugiyama | F02D 41/123 701/103 |
| 2013/0298871 | A1 | 11/2013 | Bennett et al. | |

* cited by examiner

ENGINE WITH CONTROL UNIT FOR LEAN BURN OPERATION

CROSS-REFERENCE TO RELATED PATENT APPLICATIONS

This application is a National Phase Application of PCT/US2018/044042, filed Jul. 27, 2018, which claims the benefit of U.S. Provisional Application No. 62/538,498, filed Jul. 28, 2017, both of which are incorporated herein by reference in their entireties.

BACKGROUND

The present invention generally relates to internal combustion engines and outdoor power equipment powered by such engines, such as lawn mowers, snow throwers, portable generators, etc. More specifically, the present invention relates to an engine operation control system for an engine.

Outdoor power equipment includes lawn mowers, riding tractors, snow throwers, fertilizer spreaders, salt spreaders, chemical spreaders, pressure washers, tillers, log splitters, zero-turn radius mowers, walk-behind mowers, wide area walk-behind mowers, riding mowers, stand-on mowers, pavement surface preparation devices, industrial vehicles such as forklifts, utility vehicles, commercial turf equipment such as blowers, vacuums, debris loaders, overseeders, power rakes, aerators, sod cutters, brush mowers, etc. Outdoor power equipment may, for example use an internal combustion engine to drive an implement, such as a rotary blade of a lawn mower, a pump of a pressure washer, the auger of a snow thrower, the alternator of a generator, and/or a drivetrain of the outdoor power equipment.

SUMMARY

One embodiment of the invention relates to an internal combustion engine. The engine includes an engine block including a cylinder, a piston positioned within the cylinder and configured to reciprocate in the cylinder, an electronic throttle control system including a motor and a throttle plate, an air flow sensor configured to detect an air mass flow rate, a fuel system for supplying a controlled amount of fuel to the cylinder including a fuel injector, and an engine control unit coupled to the fuel system and the electronic throttle control system. The engine control unit is configured to determine engine speed data including a current engine speed, a previous engine speed, and a desired engine speed, control a fuel injection duration based on the engine speed data, determine air-fuel ratio data comprising a current air-fuel ratio and a desired air-fuel ratio, and control a throttle plate position based on the air-fuel ratio data.

Another embodiment of the invention relates to an engine control unit. The engine control unit is coupled to an electronic fuel injection system and an electronic throttle control system of an engine. The engine control unit is configured to determine engine speed data including a current engine speed, a previous engine speed, and a desired engine speed, control a fuel injection duration based on the engine speed data, determine air-fuel ratio data including a current air-fuel ratio and a desired air-fuel ratio, and control a throttle plate position based on the air-fuel ratio data.

Another embodiment of the invention relates to an internal combustion engine. The engine includes an engine block including a cylinder, a piston positioned within the cylinder, wherein the piston is configured to reciprocate in the cylinder, an electronic throttle control system including a motor and a throttle plate, an air flow sensor configured to detect an air mass flow rate, a fuel system for supplying a controlled amount of fuel to the cylinder including a fuel injector, and an engine control unit coupled to the fuel system and the electronic throttle control system. The engine control unit is configured to determine engine speed data including a current engine speed, a previous engine speed, and a desired engine speed, determine air-fuel ratio data including a current air-fuel ratio and a desired air-fuel ratio, control a fuel injection duration and a throttle plate position, and switch between a lean burn operation and a rich burn operation.

Alternative exemplary embodiments relate to other features and combinations of features as may be generally recited in the claims.

BRIEF DESCRIPTION OF THE DRAWINGS

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring generally to the figures, an engine operation control system is discussed herein. The engine operation control system 100 described herein controls the load and the air-fuel ratio of an engine using changes in fuel injection duration and throttle position. As the load on the engine increases, the speed of the engine decreases and using the controls and methods described herein, the fuel injection duration is increased, and subsequently, the throttle position is increased (e.g., throttle plate is opened) in order to obtain a target air-fuel ratio (e.g., stoichiometric ratio) and engine speed. Accordingly, the system described herein utilizes an "air follows fuel" approach, where controlling the fuel injection controls the load and controlling the throttle position controls the air-fuel ratio. In this regard, when the load on the engine increases, an engine control unit detects the resulting decreased engine speed and commands a fuel injector to increase the fuel injection duration. Then, an electronic throttle control system opens the throttle to target a desired air-fuel ratio.

During conventional lean (or stoichiometric) operation of an engine, a "fuel follows air" approach is used, where in response to a load and resulting engine speed decrease, the governor opens the throttle and then, the fuel injection duration is increased. Using this approach, a significant power reduction or instability can be seen due to the amount of air-fuel ratio change in the lean (less stable) direction. This power reduction can lead to a "stumble" during load pickup of the engine and can, in certain instances, cause the engine to stop running if the load increases significantly. Using the control systems and methods described herein, instead of using a "fuel follows air" approach where the throttle position controls the load and the fuel injection controls the air-fuel ratio, an "air follows fuel" approach is used.

Figure 1:
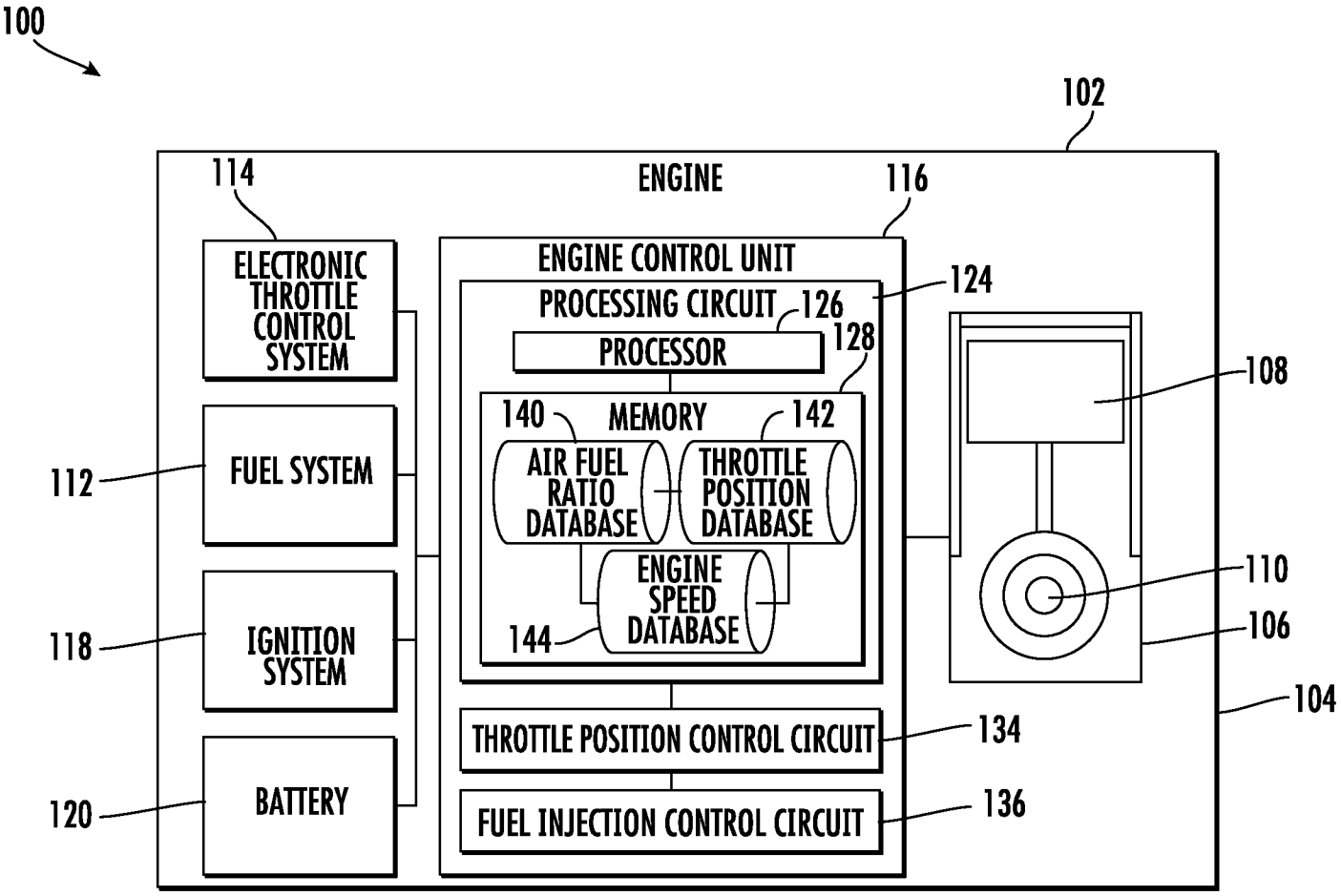
FIG. 1 is a schematic diagram of an engine operation control system for an internal combustion engine, according to an exemplary embodiment.

Referring to FIG. 1, an engine operation control system is shown according to an exemplary embodiment. The engine operation control system 100 includes an internal combustion engine 102, including an engine block 104 having a cylinder 106, a piston 108, and a crankshaft 110. The piston 108 reciprocates in the cylinder 106 to drive the crankshaft 110. The engine 102 additionally includes a fuel system 112 for supplying fuel to the cylinder 106 (e.g., a carburetor, an electronic fuel injection system, etc.). In some embodiments, the engine 102 is a single-cylinder engine. In other embodiments, the engine includes two (e.g., in a V-twin configuration) or more cylinders.

The engine 100 also includes an engine control unit (ECU) 116, an electronic throttle control system 114, a fuel system 112 (e.g., electronic fuel injection (EFI) system), an ignition system 118, and a battery 120. The fuel system 112 and electronic throttle control system 114 are in communication with the ECU 116 such that the fuel and electronic throttle control systems 112, 114 receive information and signals from the ECU 116. When the fuel system 112 receives the appropriate signals from the ECU 116, a fuel injector 130 (shown in FIG. 3) provides fuel for combustion by the engine 102. The battery 120 provides electrical power to the engine electrical systems (e.g., ECU 116, fuel system 112, ignition system 118, electronic throttle control system 114). In some embodiments, the battery 120 includes a lithium-ion battery cell, or other appropriate battery cell, located within a housing.

As shown in FIG. 1, the engine electrical systems include an ECU 116 configured to control operation of the engine 102, including the electronic throttle control system 114 and fuel system 112. The ECU 116 includes a processing circuit 124 having a processor 126 and memory 128. The processor 126 may be implemented as a general-purpose processor, an application specific integrated circuit (ASIC), one or more field programmable gate arrays (FPGAs), a digital signal processor (DSP), a group of processing components, or other suitable electronic processing components. The memory 128 includes one or more memory devices (e.g., RAM, NVRAM, ROM, Flash Memory, hard disk storage, etc.) that store data and/or computer code for facilitating the various processes described herein. Moreover, the memory 128 may be or include tangible, non-transient volatile memory or non-volatile memory.

The ECU 116 includes an air-fuel ratio database 140, a throttle position database 142, and an engine speed database 144. In some arrangements, the memory 128 includes one or more of the air-fuel ratio database 140, the throttle position database 142, and the engine speed database 144. In other arrangements, one or more of the databases 140, 142, 144 are separate data storage devices from the memory 128. The air-fuel ratio database 140 is configured to hold, store, categorize, and otherwise serve as a repository for information associated with the air-fuel ratio being supplied to the engine 102. The database 140 may include, for example, historical air-fuel ratio data, tables used to calculate the air-fuel ratio based on input values, such as manifold pressure, temperature, engine speed, etc.

Figure 2:
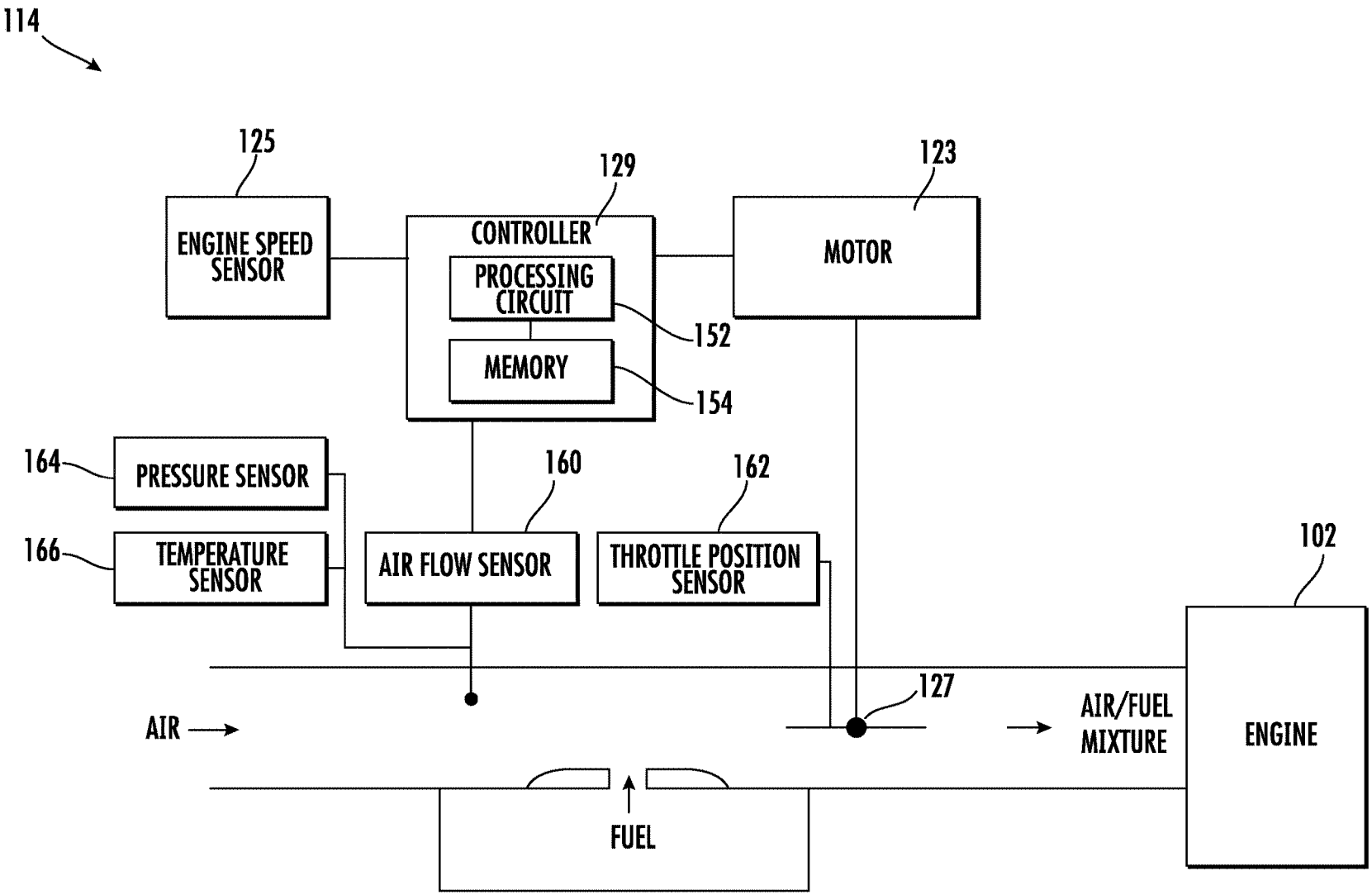
FIG. 2 is a schematic diagram of an electronic throttle control system for use with the engine operation control system of FIG. 1, according to an exemplary embodiment.

The throttle position database 142 is configured to hold, store, categorize, and otherwise serve as a repository for information associated with a position of the throttle plate 127 (shown in FIG. 2). The throttle position database 142 also includes tables corresponding to the change in the throttle position based on various input values, including, but not limited to, the air-fuel ratio, the fuel injection quantity, various engine component pressures and temperatures, etc. The throttle position database 142 can be a listing of values indicating the amount by which the throttle plate should be opened or closed during adjustment of the throttle position, as will be discussed further with regard to FIG. 5.

The engine speed database 144 is configured to hold, store, categorize, and otherwise serve as a repository for information associated with the engine speed. The engine speed database 144 includes tables corresponding to desired engines speeds, magnitude in fuel injection duration changes corresponding to differences between current and desired engine speeds, and so on. Accordingly, the engine speed database 144 includes a listing of values indicating the amount by which the fuel injection duration should be increased or decreased during adjustment of the fuel injection, as will be discussed further with regard to FIG. 4.

The ECU 116 additionally includes a throttle position control circuit 134 configured to receive values relating to throttle position, fuel injection, air mass flow, air-fuel ratios, pressures, and temperatures and calculate current air-fuel ratios, differences between current and desired air-fuel ratios, and the amount at which the throttle plate should be moved to reach the desired air-fuel ratio. As such, the throttle position control circuit 134 is communicably and operatively coupled to the throttle position database 142 and the air-fuel ratio database to determine at least a portion of those values and is also communicably and operatively coupled to the air flow sensor 160, throttle position sensor 162, pressure sensor 164, and temperature sensor 166 of the electronic throttle control system 114 (shown in FIG. 2). Additionally, the throttle position control circuit 134 is configured to communicate with the controller 129 of the electronic throttle control system 114 to operate the motor 123 to move (e.g., open or close) the throttle plate 127 to a desired position.

Still referring to FIG. 1, the ECU 116 also includes a fuel injection control circuit 136 configured to receive values relating to fuel injection duration and engine speed and calculate differences between current and previous engine speeds, differences between current and desired engine speeds, and the amount which the fuel injection duration should be increased or decreased. In this regard, the fuel injection control circuit 136 is communicably and operatively coupled to the engine speed database 144 to receive previous and desired engine speed values and to access a listing of values indicating the amount by which the fuel injection duration should be increased or decreased during adjustment of the fuel injection. The fuel injection control circuit 136 is also configured to communicate with the controller 135 of the fuel injector 130 (shown in FIG. 3) to control (e.g., increase or decrease) the duration of the fuel injection.

The ECU 116 is configured to allow for switches between the lean burn operation described herein and a rich burn operation. In some arrangements, the ECU 116 may detect a light load on the engine 102 and as a result, command a switchover to a traditional rich burn operation to ensure stability during operation. Using a traditional rich burn operation during times of light load on the engine may provide more stability during combustion processes. To determine when a switch from the lean burn operation to a rich burn operation, the ECU 116 can detect a decrease in load using various signals from sensors included herein (e.g., engine speed sensor 125) and signal the fuel injection control circuit 136 and throttle position control circuit 134 to operate in a typical "fuel follows air" control operation, where the load is controlled by the throttle position and the air-fuel ratio is controlled using fuel injection changes. Once the load increases, the ECU 116 can then signal a switch back to the lean burn operation discussed herein.

Referring to FIG. 2, an electronic throttle control system 114 is illustrated, according to an exemplary embodiment. The electronic throttle control system 114 is structured to maintain a desired engine speed in response to varying loads applied to the engine 102. The electronic throttle control system 114 includes a controller 129 and a motor 123 coupled to a throttle plate 127 via a connection device, such as a throttle shaft, to control the position of the throttle plate 127 (e.g., open and close a throttle plate 127) in response to changes in the air-fuel ratio of the engine 102. The throttle plate 127 controls the flow of an air/fuel mixture into the combustion chamber of the engine 102 and in doing so controls the air-fuel ratio of the engine 102. The throttle plate 127 is movable between a closed position and a wide-open position. As described below with regard to FIG. 5, the position of the throttle plate 127 is adjusted so that the air-fuel ratio is maintained at a desired air-fuel ratio.

The controller 129 controls operation of the motor 123 to control the position of the throttle plate 127. In some embodiments, the controller 129 controls other operations of the engine 102, such as described below (e.g., fuel delivery injector). An engine speed sensor 125 is coupled to the controller 129 to provide an engine speed input to the ECU 116. In some embodiments, the engine speed sensor 125 detects the engine speed using an ignition signal from the ignition system. For example, positive sparks or pulses from the ignition system could be counted and used to determine the engine speed. In other embodiments, other appropriate engine speed sensors are utilized. The controller 129 may include a processing circuit 152 and a memory 154. The processing circuit 152 may include an ASIC, one or more FPGAs, a DSP, circuits containing one or more processing components, circuitry for supporting a microprocessor, a group of processing components, or other suitable electronic processing components. In some embodiments, the processing circuit 152 is configured to execute computer code stored in the memory 154 to facilitate the systems and processes described herein. The memory 154 may be any volatile or non-volatile computer-readable storage medium capable of storing data or computer code relating to the systems and processes described herein. According to an exemplary embodiment, the memory 154 includes computer code modules (e.g., executable code, object code, source code, script code, machine code, etc.) configured for execution by the processing circuit 152.

The fuel system 112 is structured to provide the proper fuel amount to the engine 102 for combustion processes. In some embodiments, the fuel system 112 includes an EFI system. In other embodiments, the fuel system 112 includes a carburetor, fuel delivery injector, or other fuel delivery device.

Figure 3:
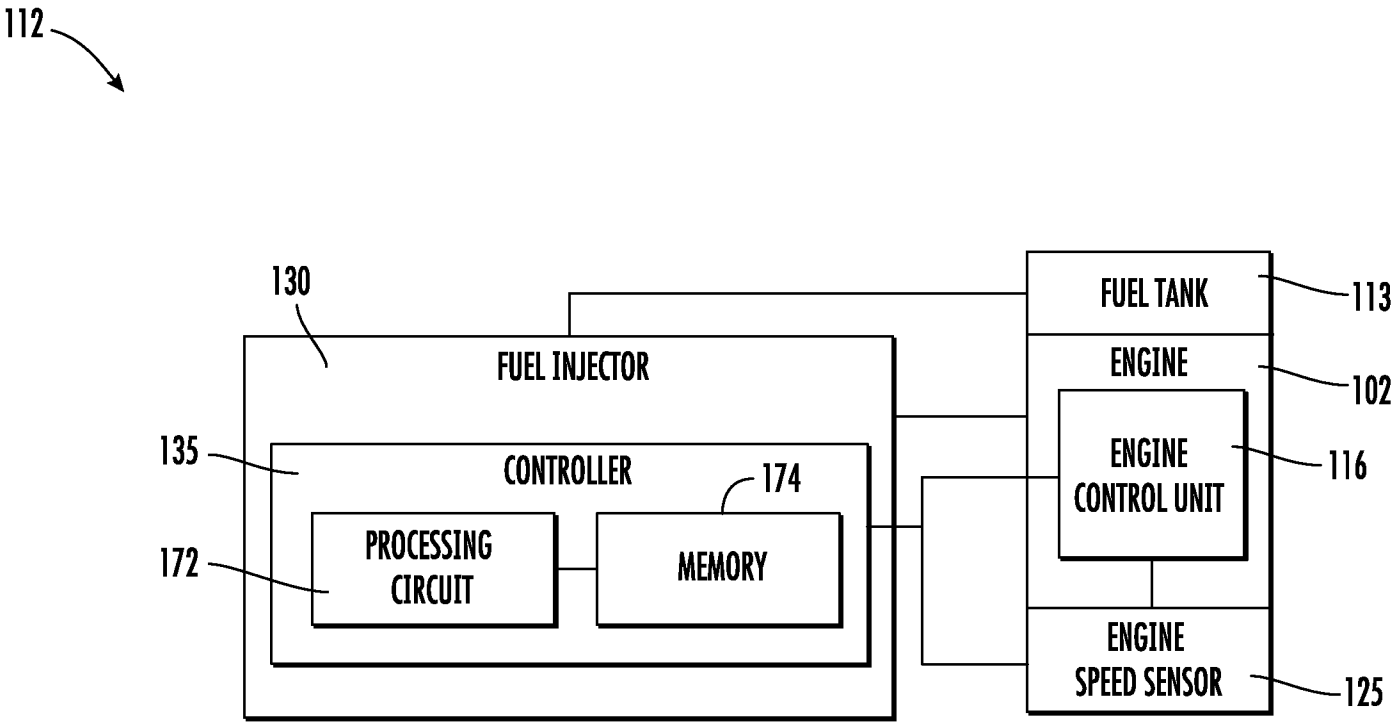
FIG. 3 is a schematic diagram of a fuel delivery injector for use with the engine operation control system of FIG. 1, according to an exemplary embodiment.

In some embodiments, the fuel system 112 includes a fuel injector 130, as shown in FIG. 3. In some embodiments, the fuel injector is a fuel delivery injector (FDI) unit including a controller 135 configured to selectively engage, selectively disengage, control, and/or otherwise communicate with components of the fuel injector 130 (e.g., actively control the components thereof, etc.). Accordingly the controller 135 can control the duration of fuel injection in response to changes in the engine speed, as discussed further with regard to FIG. 4. According to the exemplary embodiment shown in FIG. 3, the controller 135 includes a processing circuit 172 and a memory 174. The processing circuit 172 may include an ASIC, one or more FPGAs, a DSP, circuits containing one or more processing components, circuitry for supporting a microprocessor, a group of processing components, or other suitable electronic processing components. In some embodiments, the processing circuit 172 is configured to execute computer code stored in the memory 174 to facilitate the systems and processes described herein. The memory 174 may be any volatile or non-volatile computer-readable storage medium capable of storing data or computer code relating to the systems and processes described herein. According to an exemplary embodiment, the memory 174 includes computer code modules (e.g., executable code, object code, source code, script code, machine code, etc.) configured for execution by the processing circuit 172.

As shown in FIG. 3, the fuel injector 130 receives fuel from the fuel tank 113 and injects fuel into the engine 102. The duration of the fuel injection is dependent on signals received from the controller 135, which is communicably and operatively coupled to the ECU 116 and an engine speed sensor 125. The engine speed sensor 125 communicates current engine speed values to both the ECU 116 and the fuel injector controller 135.

Figure 4:
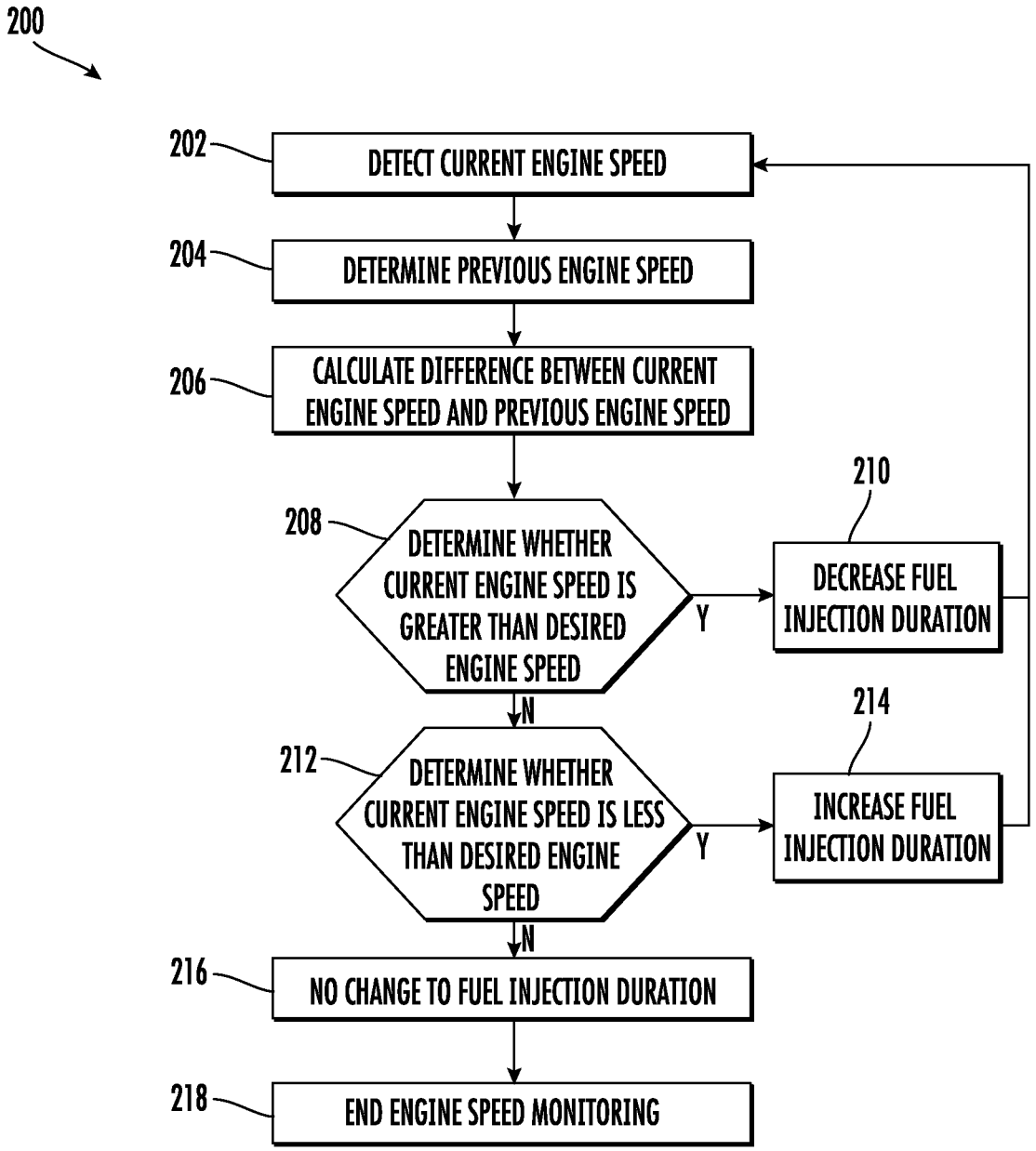
FIG. 4 is a flow diagram of a method of engine speed control using the engine operation control system of FIG. 1, according to an exemplary embodiment.

Referring to FIG. 4, a method of engine speed control is shown, according to an exemplary embodiment. The method 200 is performed by the ECU 116 shown in FIG. 1. The ECU 116 receives engine speed data from the engine speed sensor 125 and the engine speed database 144 and based on the engine speed data, controls the operations of the fuel injector 130, shown in FIG. 3, to increase, decrease or maintain a desired engine speed. In some arrangements, the desired engine speed may be a range of desired engine speed such that comparison of a current engine speed to a desired engine speed may include a tolerance in addition to a specific desired engine speed value. Accordingly, reference to FIGS. 1-3 may be made in the description of method 200.

A current engine speed is detected at 202. The current engine speed is detected by the engine speed sensor 125. As described above, the engine speed sensor 125 is coupled to the controller 129 to provide an engine speed input to the electronic throttle control system 114. Additionally as shown in FIG. 3, the engine speed sensor 125 is communicably and operatively coupled to the ECU 116 to provide an engine speed input to the fuel injection control circuit 136. In some embodiments, the engine speed sensor 125 detects the engine speed using an ignition signal from the ignition system 118. For example, positive sparks or pulses from the ignition system could be counted and used to determine the engine speed. In other embodiments, other appropriate engine speed sensors are utilized.

A previous engine speed is determined at 204. The previous engine speed is retrieved from the engine speed database 144. Next, the difference between the current engine speed and the previous engine speed is calculated at 206. The calculation may be performed by the fuel injection control circuit 136. Accordingly, the fuel injection control circuit 136 receives the current engine speed and previous engine speed and performs the difference calculation.

It is determined whether the current engine speed is greater than a desired engine speed at 208. If the current engine speed is greater than the desired engine speed, the fuel injection duration is decreased at 210. As noted above, the fuel injection control circuit 136 determines the difference between the current and previous engine speeds and thus, also determines whether the current engine speed is greater or less than the previous engine speed. Using this information, if the current engine speed is greater than the previous engine speed, the fuel injection control circuit 136 signals to the fuel injector 130 to decrease the duration of the fuel injection into the engine 102.

In some arrangements, the fuel injection control circuit 136 additionally determines the amount of decrease in duration of fuel injection using a look-up table stored in the engine speed database 144 and the calculated difference between previous and current engine speed (calculated at 206). The look-up table includes a listing of differences in current and previous engine speeds (both positive and negative) and the respective difference in duration of fuel injection for each determined engine speed change. For example, if the fuel injection control circuit 136 determines the current engine speed has increased by X revolutions per minute from the previous engine speed, the fuel injection control circuit 136 determines that the fuel injection duration should be decreased by Y seconds by retrieving that value from a look-up table stored in the engine speed database 144.

If it is determined that the current engine speed is not greater than the desired engine speed, the method proceeds to step 212, where it is determined whether the current engine speed is less than a desired engine speed. If the current engine speed is less than the desired engine speed, the fuel injection duration is increased at 214. After determining that the current engine speed is less than the desired engine speed, the fuel injection control circuit 136 accesses the engine speed database 144 to retrieve a value indicating a relative increase in fuel injection duration and then signals that value to the fuel injector 130. If it is determined that the current engine speed is not less than the desired engine speed, then the engine speed equals the desired engine speed and no change to the fuel injection is initiated and the engine speed monitoring is ended at 218. In some arrangements, the engine speed monitoring does not end at 218 and instead, the control system 100 continuously monitors the engine speed.

Figure 5:
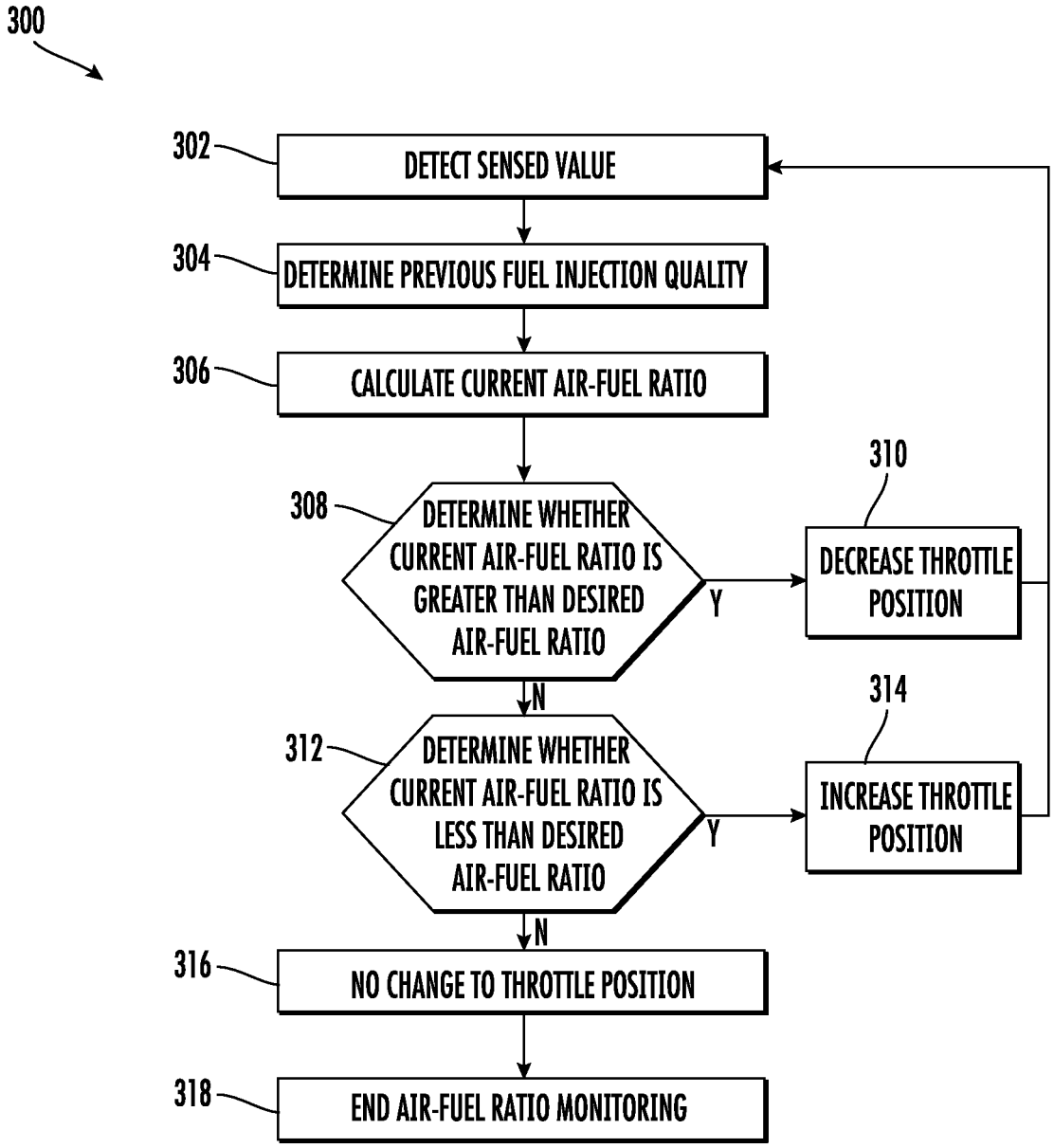
FIG. 5 is a flow diagram of a method of air-fuel ratio control using the engine operation control system of FIG. 1, according to an exemplary embodiment.

Referring to FIG. 5, a method of air-fuel ratio control is shown, according to an exemplary embodiment. The method 300 is performed by the ECU 116 shown in FIG. 1. The ECU 116 receives air mass flow data from the air flow sensor 160, the pressure sensor 164, and/or the temperature sensor 166, and the air-fuel ratio database 140. The ECU 116 also receives throttle position data from the throttle position sensor 162 and the throttle position database 142. In some arrangements, no throttle position sensor 162 is included. Based on the received air flow data and a previous fuel injection quantity, the ECU 116 controls the operations of the motor 123 controlling the throttle plate 127, shown in FIG. 3, to open, close, or maintain a current throttle position. By controlling the throttle plate position, the ECU 116 controls the air-fuel ratio to a desired air-fuel ratio. In some arrangements, the desired air-fuel ratio may be a range of desired air-fuel ratios such that comparison of a current air-fuel ratio to a desired air-fuel ratio may include a tolerance in addition to a specific desired air-fuel ratio value. Accordingly, reference to FIGS. 1-3 may be made in the description of method 300.

A sensed value is detected at 302. The sensed value may include sensed air mass flow values received from the air flow sensor 160, sensed pressure values received from the pressure sensor 164, and/or sensed temperature values received from the temperature sensor 166. Accordingly, the air flow sensor 160, pressure sensor 164, and temperature sensor 166 are communicably and operatively coupled to the ECU 116, and more specifically, to the throttle position control circuit 134.

A previous fuel injection quantity is determined at 304. The previous fuel injection quantity may be retrieved from the air-fuel ratio database 140. Each time the fuel injector 130 injects an amount of fuel, the controller 135 for the fuel injector 130 communicates the injection amount to the ECU 116, which then stores the fuel injection quantity in the air-fuel ratio database 140 for later retrieval.

Next, the current air-fuel ratio is calculated at 306. The calculation may be performed by the throttle position control circuit 134. Accordingly, the throttle position control circuit 136 receives the sensed values at step 302 and the previous fuel injection quantity and uses those values to calculate the current air-fuel ratio. For example, the air mass flow data received from the air flow sensor 160 and the previous fuel injection quantity are used to calculate the current air-fuel ratio. As another example, the temperature and pressure data received from the temperature and pressure sensors 166, 164 and the previous fuel injection quantity are used to calculate the current air-fuel ratio. In further arrangements, a throttle position sensor 162 is used in combination with the temperature sensor 166, along with the previous fuel injection quantity are used to calculate the current air-fuel ratio. In another embodiment, the air-fuel ratio is measured by an oxygen sensor.

It is determined whether the current air-fuel ratio is greater than a desired air-fuel ratio at 308. If the current air-fuel ratio is greater than the desired air-fuel ratio, the throttle position is decreased (e.g., closed) at 310. As noted above, the throttle position control circuit 134 calculates the current air-fuel ratio using air mass flow values (or temperature and pressure values). The throttle position circuit 134 then compares the current air-fuel ratio to the desired air-fuel ratio. The throttle position circuit 134 retrieves the desired air-fuel ratio that is stored in the air-fuel ratio database 140 to complete this comparison.

In some arrangements, the throttle position control circuit 134 may use the difference between the desired air-fuel ratio and the current air-fuel ratio to determine the magnitude at which to increase or decrease the throttle plate position (e.g., open or close the throttle plate 127). The throttle position control circuit 134 can utilize a look-up table stored in the throttle position database 142 to determine the magnitude at which to open or close the throttle plate 127. The look-up table includes a listing of differences between the desired air-fuel ratio and the current air-fuel ratio and the relative magnitude of throttle plate movement to signal to the controller 129. For example, if the throttle position control circuit 134 determines the current air-fuel ratio is greater than the desired air-fuel ratio by X value, the throttle position control circuit 134 determines that the throttle plate position should be decreased by Y percentage by retrieving that value from the throttle position database 142.

If it is determined that the current air-fuel ratio is not greater than the desired air-fuel ratio, the method proceeds to step 312, where it is determined whether the current air-fuel ratio is less than a desired air-fuel ratio. If the current air-fuel ratio is less than the desired air-fuel ratio, the throttle position is increased at 314. After determining that the current air-fuel ratio is less than the desired air-fuel ratio, the throttle position control circuit 136 accesses the throttle position database 142 to retrieve a value indicating a relative increase in throttle position and then signals that value to the controller 129 to activate the motor 123 to move the throttle plate 127. If it is determined that the current air-fuel ratio is not less than the desired air-fuel ratio, then the air-fuel ratio equals the desired air-fuel ratio and no change to the throttle position is initiated and the air-fuel ratio monitoring is ended at 318. In some arrangements, the air-fuel ratio monitoring does not end at 318 and instead, the control system 100 continuously monitors the air-fuel ratio of the engine 102.

In some arrangements, method 200 shown in FIG. 4, which controls the engine speed using changes in the duration of fuel injection may run approximately a quarter-cycle (e.g., in reference to engine stroke/combustion cycles) ahead of method 300 shown in FIG. 5, which controls the air-fuel ratio using changes in the position of the throttle plate 127.

Figure 6:
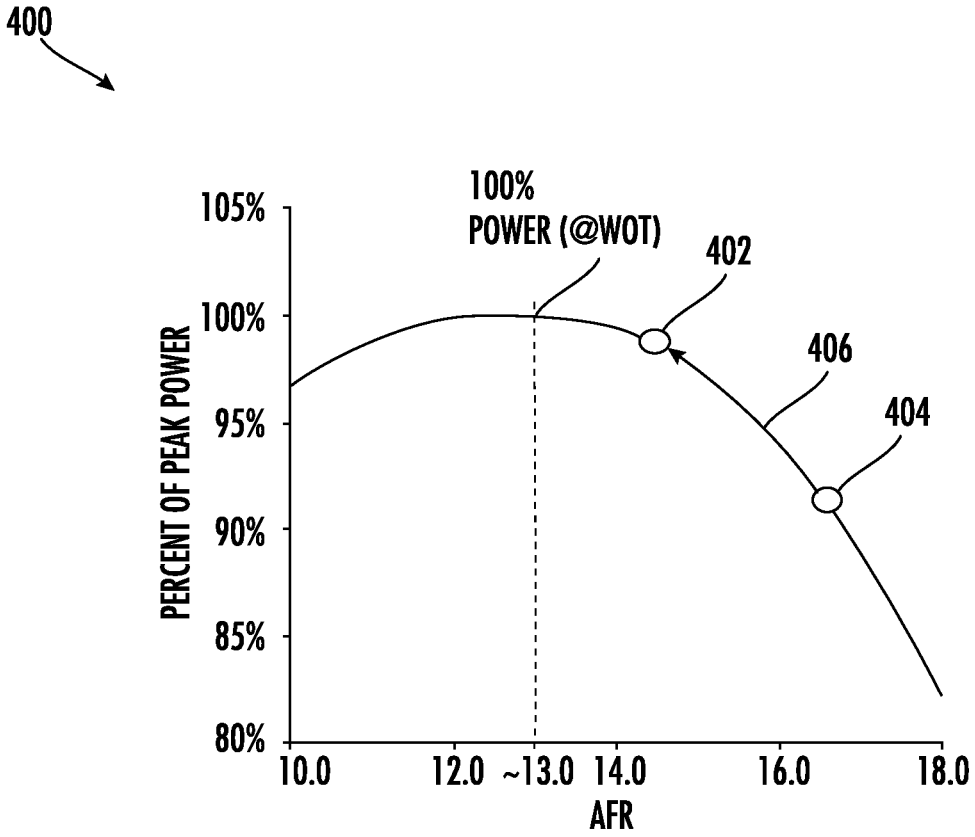
FIG. 6 is a graph displaying percentage of peak power of an engine versus an air-fuel ratio.

Referring to FIG. 6, a graph 400 depicting percentage of peak engine power versus air-fuel ratio is shown. As shown, at 100% power, the air-fuel ratio is approximately at 13.0. Using the lean burn control system described herein, the engine 102 may start at point 404 (at around 91% power with an air-fuel ratio of 16.5) and accelerated along path 406 to point 402 (at around 98% power with an air-fuel ratio of 14.5). Accordingly, as the engine is accelerated, the air-fuel ratio decreases, allowing for a more stable operation at near full power of the engine. When the engine is accelerated, the fuel injector is commanded to increase the fuel injection duration and the throttle position is opened to target the desired air-fuel ratio.

Figure 7:
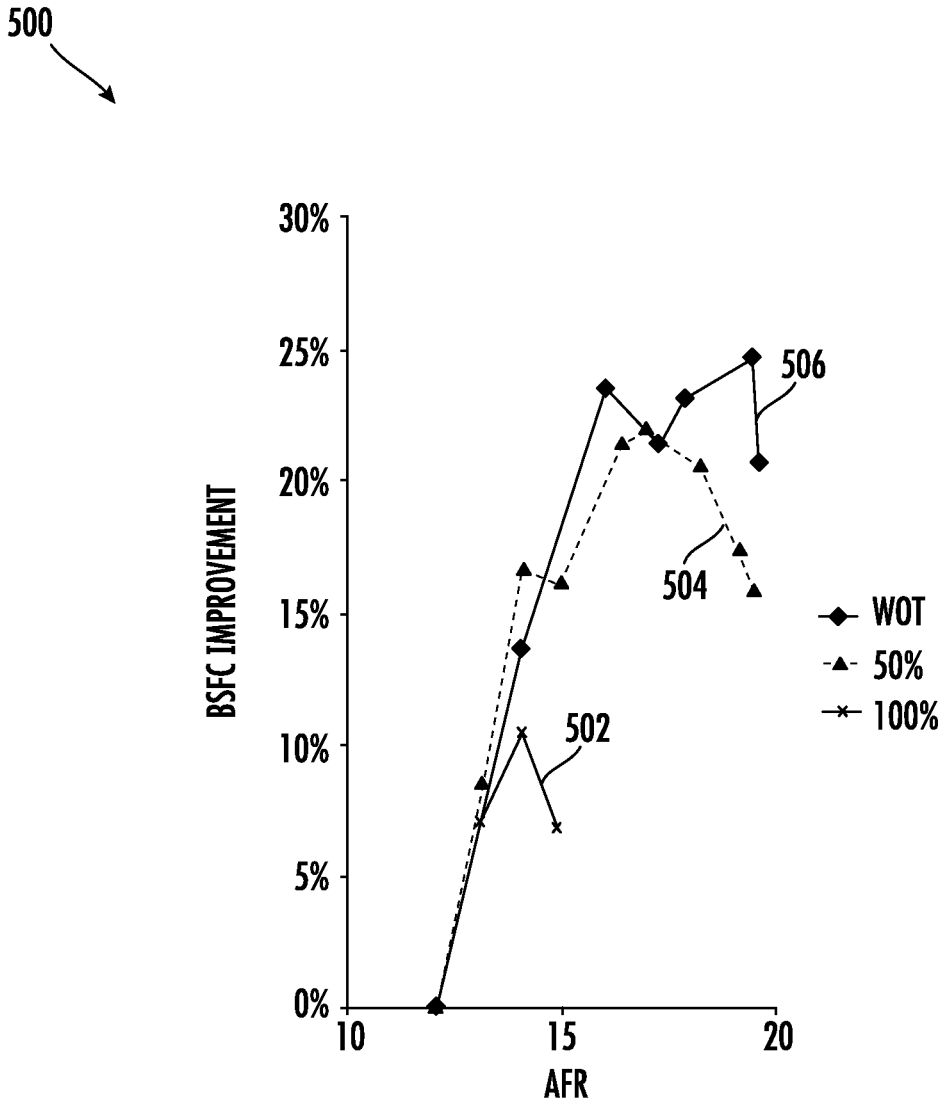
FIG. 7 is a graph displaying brake specific fuel consumption versus an air-fuel ratio.

Referring to FIG. 7, a graph 500 depicting a percentage of brake specific fuel consumption (BSFC) improvement over traditional engine operation versus air-fuel ratio is shown. Graph 500 shows line 502 depicting BSFC improvement versus air-fuel ratio for a 10% open throttle condition, line 504 for a 50% open throttle condition, and line 506 for a wide-open throttle condition. The BSFC improvement values shown in graph 500 for the engine operation control system described herein show an approximate improvement of 10-20% over a traditional engine operation.

Figure 8:
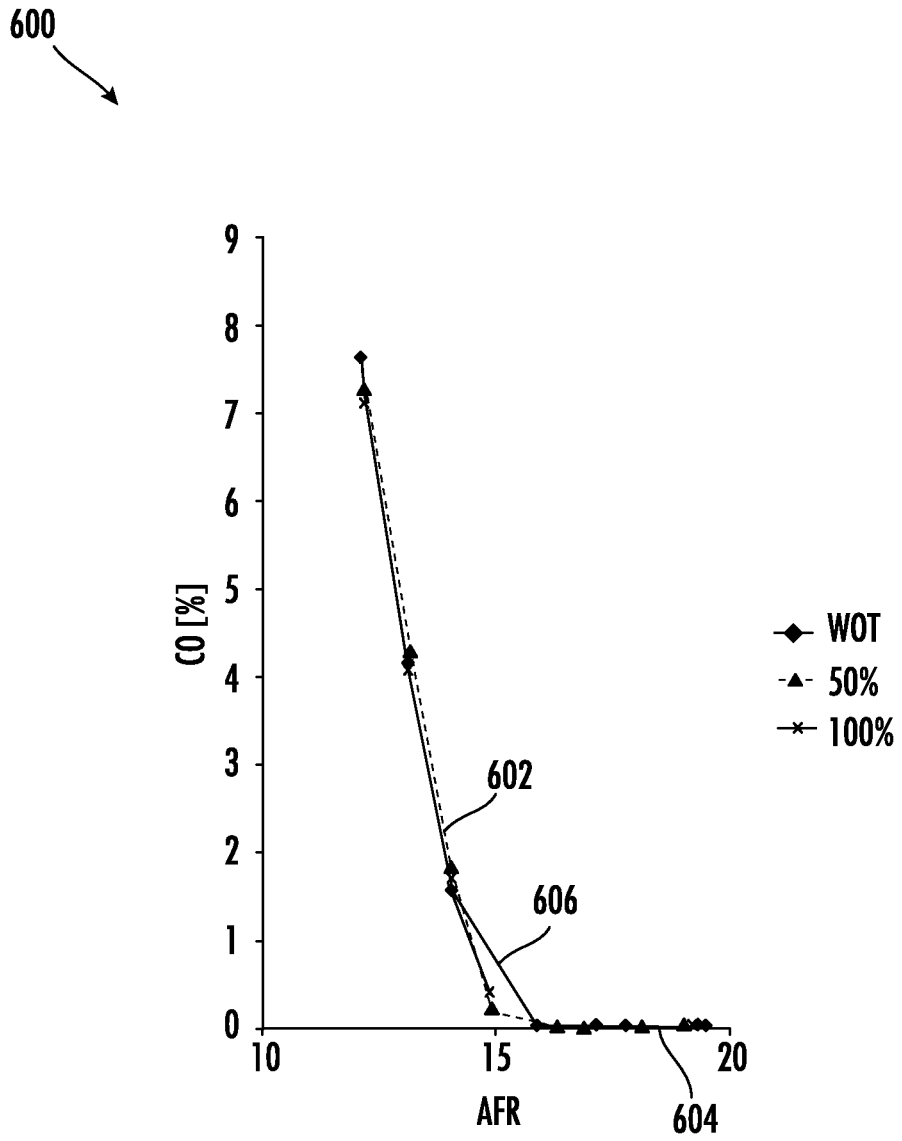
FIG. 8 is a graph displaying percentage of carbon monoxide (CO) emissions versus an air-fuel ratio.

Referring to FIG. 8, a graph 600 depicting percentage of CO emission improvement over traditional engine operation versus air-fuel ratio is shown. Graph 600 shows line 602 depicting CO percentage improvement versus air-fuel ratio for a 10% open throttle condition, line 604 for a 50% open throttle condition, and line 606 for a wide-open throttle condition. The CO emission improvement values for the engine operation control system described herein show the ability of near-zero CO emissions when running lean.

For conventional gasoline engines, as the load on the engine increases, the engine speed decreases and a governor opens the throttle in response. In a carbureted engine, the increased air flow draws in more fuel and in an EFI system, the ECU detects the increased intake pressure and signals for a longer fuel injection duration. Accordingly, in traditional gasoline engines, the fuel injection controls the air-fuel ratio and the throttle position controls the load on the engine. As noted above, it may be desirable to provide a system allowing for switching between this traditional method of controlling an engine with a method for controlling operation of the engine as described herein. This type of dual-control system allows for switching between a rich burn operation and a lean burn operation, where the rich burn operation may follow the traditional control method and the lean burn operation may follow the method described herein. In some arrangements, the systems described herein may also utilize additional controls to determine the rate of change of engine speed, identify a significant load on the engine, adding more fuel, and using this information to determine when to change the throttle position.

The construction and arrangements of an engine operation control system for an engine, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

The embodiments described herein have been described with reference to drawings. The drawings illustrate certain details of specific embodiments that implement the systems, methods and programs described herein. However, describing the embodiments with drawings should not be construed as imposing on the disclosure any limitations that may be present in the drawings.

As used herein, the term "circuit" may include hardware structured to execute the functions described herein. In some embodiments, each respective "circuit" may include machine-readable media for configuring the hardware to execute the functions described herein. The circuit may be embodied as one or more circuitry components including, but not limited to, processing circuitry, network interfaces, peripheral devices, input devices, output devices, sensors, etc. In some embodiments, a circuit may take the form of one or more analog circuits, electronic circuits (e.g., integrated circuits (IC), discrete circuits, system on a chip (SOCs) circuits, etc.), telecommunication circuits, hybrid circuits, and any other type of "circuit." In this regard, the "circuit" may include any type of component for accomplishing or facilitating achievement of the operations described herein. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on).

The "circuit" may also include one or more dedicated processors communicatively coupled to one or more dedicated memory or memory devices. In this regard, the one or more dedicated processors may execute instructions stored in the dedicated memory or may execute instructions otherwise accessible to the one or more dedicated processors. In some embodiments, the one or more dedicated processors may be embodied in various ways. The one or more dedicated processors may be constructed in a manner sufficient to perform at least the operations described herein. In some embodiments, the one or more dedicated processors may be shared by multiple circuits (e.g., circuit A and circuit B may comprise or otherwise share the same processor which, in some example embodiments, may execute instructions stored, or otherwise accessed, via different areas of memory). Alternatively or additionally, the one or more dedicated processors may be structured to perform or otherwise execute certain operations independent of one or more co-processors. In other example embodiments, two or more processors may be coupled via a bus to enable independent, parallel, pipelined, or multi-threaded instruction execution. Each processor may be implemented as one or more general-purpose processors, application specific integrated circuits (ASICs), field programmable gate arrays (FPGAs), digital signal processors (DSPs), or other suitable electronic data processing components structured to execute instructions provided by memory. The one or more dedicated processors may take the form of a single core processor, multi-core processor (e.g., a dual core processor, triple core processor, quad core processor, etc.), microprocessor, etc.

It should be noted that although the diagrams herein may show a specific order and composition of method steps, it is understood that the order of these steps may differ from what is depicted. For example, two or more steps may be performed concurrently or with partial concurrence. Also, some method steps that are performed as discrete steps may be combined, steps being performed as a combined step may be separated into discrete steps, the sequence of certain processes may be reversed or otherwise varied, and the nature or number of discrete processes may be altered or varied. The order or sequence of any element or apparatus may be varied or substituted according to alternative embodiments. Accordingly, all such modifications are intended to be included within the scope of the present disclosure as defined in the appended claims.

The foregoing description of embodiments has been presented for purposes of illustration and description. It is not intended to be exhaustive or to limit the disclosure to the precise form disclosed, and modifications and variations are possible in light of the above teachings or may be acquired from this disclosure. The embodiments were chosen and described in order to explain the principals of the disclosure and its practical application to enable one skilled in the art to utilize the various embodiments and with various modifications as are suited to the particular use contemplated. Other substitutions, modifications, changes and omissions may be made in the design, operating conditions and arrangement of the embodiments without departing from the scope of the present disclosure as expressed in the appended claims.

What is claimed is:

1. An internal combustion engine comprising:

an engine block including a cylinder;

a piston positioned within the cylinder, wherein the piston is configured to reciprocate in the cylinder;

an electronic throttle control system comprising a motor and a throttle plate;

an air flow sensor configured to detect an air mass flow rate;

a fuel system for supplying a controlled amount of fuel to the cylinder including a fuel injector; and an engine control unit coupled to the fuel system and the electronic throttle control system configured to:

determine engine speed data comprising a current engine speed, a previous engine speed, and a desired engine speed;

control a fuel injection duration based on the engine speed data;

determine air-fuel ratio data comprising a current air-fuel ratio and a desired air-fuel ratio; and control a throttle plate position based on the air-fuel ratio data.

2. The internal combustion engine of claim 1, wherein the engine control unit comprises:

an air-fuel ratio database configured to retrievably store the air-fuel data; and an engine speed database configured to retrievably store the engine speed data;

wherein the engine control unit receives the engine speed data from an engine speed sensor and stores the engine speed data in the engine speed database;

wherein the engine control unit receives the air-fuel ratio data from the air flow sensor and stores the air-fuel ratio data in the air-fuel ratio database.

3. The internal combustion engine of claim 2, wherein the engine control unit further comprises:

a throttle position control circuit configured to adjust the throttle plate position in response to determining a difference between the current air-fuel ratio and the desired air-fuel ratio; and a fuel injection control circuit configured to adjust the fuel injection duration in response to determining a difference between the current engine speed and the desired engine speed.

4. The internal combustion engine of claim 2, wherein the engine control unit is configured to:

detect the current engine speed;

retrieve the desired engine speed from the engine speed database;

retrieve the previous engine speed from the engine speed database;

calculate a difference between the current engine speed and the previous engine speed;

determine that the current engine speed is greater than the desired engine speed; and decrease the fuel injection duration.

5. The internal combustion engine of claim 4, wherein the engine control unit is further configured to:

calculate a difference between the current engine speed and the previous engine speed; and decrease the fuel injection duration by a decrease amount corresponding to the difference between the current engine speed and the previous engine speed.

6. The internal combustion engine of claim 2, wherein the engine control unit is configured to:

detect the current engine speed;

retrieve the desired engine speed from the engine speed database;

retrieve the previous engine speed from the engine speed database;

determine that the current engine speed is less than the desired engine speed; and increase the fuel injection duration.

7. An engine control unit coupled to an electronic fuel injection system and an electronic throttle control system of an engine, wherein the engine control unit is configured to:

determine engine speed data comprising a current engine speed, a previous engine speed, and a desired engine speed;

control a fuel injection duration based on the engine speed data;

determine air-fuel ratio data comprising a current air-fuel ratio and a desired air-fuel ratio; and control a throttle plate position based on the air-fuel ratio data.

8. The engine control unit of claim 7, further comprising:

an air-fuel ratio database configured to retrievably store the air-fuel ratio data; and an engine speed database configured to retrievably store the engine speed data;

wherein the engine control unit receives the engine speed data from an engine speed sensor and stores the engine speed data in the engine speed database;

wherein the engine control unit receives the air-fuel ratio data from the air flow sensor and stores the air-fuel ratio data in the air-fuel ratio database.

9. The engine control unit of claim 8, further comprising:

a throttle position control circuit configured to adjust the throttle plate position in response to determining a difference between the current air-fuel ratio and the desired air-fuel ratio; and a fuel injection control circuit configured to adjust the fuel injection duration in response to determining a difference between the current engine speed and the desired engine speed.

10. The engine control unit of claim 9, wherein the fuel injection control circuit is further configured to:

detect the current engine speed;

retrieve the desired engine speed from the engine speed database;

retrieve the previous engine speed from the engine speed database;

calculate a difference between the current engine speed and the previous engine speed;

determine that the current engine speed is greater than the desired engine speed; and decrease the fuel injection duration.

11. The engine control circuit of claim 10, wherein the fuel injection control circuit is further configured to:

calculate a difference between the current engine speed and the previous engine speed; and decrease the fuel injection duration by a decrease amount corresponding to the difference between the current engine speed and the previous engine speed.

12. The engine control unit of claim 9, wherein the fuel injection control circuit is configured to:

detect the current engine speed;

retrieve the desired engine speed from the engine speed database;

retrieve the previous engine speed from the engine speed database;

determine that the current engine speed is less than the desired engine speed; and increase the fuel injection duration.

13. The engine control unit of claim 12, wherein the fuel injection control circuit is further configured to:

calculate a difference between the current engine speed and the previous engine speed; and increase the fuel injection duration by an increase amount corresponding to the difference between the current engine speed and the previous engine speed.

14. An internal combustion engine comprising:

an engine block including a cylinder;

a piston positioned within the cylinder, wherein the piston is configured to reciprocate in the cylinder;

an electronic throttle control system comprising a motor and a throttle plate;

an air flow sensor configured to detect an air mass flow rate;

a fuel system for supplying a controlled amount of fuel to the cylinder including a fuel injector; and an engine control unit coupled to the fuel system and the electronic throttle control system configured to:

determine engine speed data comprising a current engine speed, a previous engine speed, and a desired engine speed;

determine air-fuel ratio data comprising a current air-fuel ratio and a desired air-fuel ratio;

control a fuel injection duration and a throttle plate position; and switch between a lean burn operation and a rich burn operation.

15. The internal combustion engine of claim 14, wherein the engine control unit is configured to operate in the lean burn operation, the lean burn operation comprising:

controlling the fuel injection duration based on the engine speed data; and controlling a throttle plate position based on the air-fuel ratio data.

16. The internal combustion engine of claim 15, wherein the lean burn operation further comprises:

decreasing the fuel injection duration based on determining that the current engine speed is greater than the desired engine speed; and increasing the fuel injection duration based on determining that the current engine speed is less than the desired engine speed.

17. The internal combustion engine of claim 15, wherein the lean burn operation further comprises:

decreasing the throttle position based on determining that the current air-fuel ratio is greater than the desired air-fuel ratio; and increasing the throttle position based on determining that the current air-fuel ratio is less than the desired air-fuel ratio.

18. The internal combustion engine of claim 15, wherein the engine control unit is configured to switch to the rich burn operation from the lean burn operation upon detecting a decrease in a load on the engine.

19. The internal combustion engine of claim 18, wherein the rich burn operation comprises:

controlling the fuel injection duration based on the air-fuel ratio data; and controlling a throttle plate position based on the engine speed data.

20. The internal combustion engine of claim 19, wherein the rich burn operation further comprises:

decreasing the throttle position based on determining that the current engine speed is greater than the desired engine speed; and increasing the throttle position based on determining that the current engine speed is less than the desired engine speed.

* * * * *